United States Patent [19]

Kraser

[11] Patent Number: 4,522,583

[45] Date of Patent: Jun. 11, 1985

[54] CIGARETTE LIGHTER

[76] Inventor: Gary S. Kraser, 44 Narwood Rd., Massapequa, N.Y. 11758

[21] Appl. No.: 615,941

[22] Filed: May 31, 1984

[51] Int. Cl.[3] ..... F23Q 2/32

[52] U.S. Cl. ..... 431/125; 431/253; D27/40; D27/41

[58] Field of Search ..... 431/125, 126, 253; D27/40, 41

[56] References Cited

U.S. PATENT DOCUMENTS 2,531,056 11/1950 Koesten ..... 431/125

*Primary Examiner*—Carroll B. Dority, Jr.

*Attorney, Agent, or Firm*—Collard, Roe & Galgano

[57] ABSTRACT

A pocket cigarette lighter is provided in the form of a miniaturized automobile wherein the cigarette lighter mechanism is encased within the automobile body form and the ignition activation mechanism is operated by the manipulation of an element of the car body to produce a flame emanating from a nozzle which is recessed from the exterior of the miniature car body and thus concealed from view thereby. When the ignition activation mechanism is operated, it simultaneously operates the gas valve in the lighter mechanism to allow gas to exit from the nozzle and it also operates the ignition system to produce a spark for igniting the gas exiting the nozzle.

12 Claims, 9 Drawing Figures

CIGARETTE LIGHTER

The present invention relates generally to a cigarette lighter and more specifically it relates to a pocket cigarette lighter in the form of an automobile of miniature size.

There are on the market innumerable styles, shapes and sizes of cigarette lighters, some of which are pocket cigarette lighters and others of which are so-called desk-top lighters. Pocket cigarette lighters, for the most part, have been constructed to be primarily functional having a body which contains a tank for the lighter fluid, whether it be gas or fluid, a valve or wick for expanding the gas or fluid, and a mechanism for igniting the material. The ignition for such lighters which utilize gas generally develop a spark which originates from an electronic or quartz ignition. With respect to desk-top lighters, since such lighters tend to be relatively large, greater attention has been paid to the aesthetic appearance thereof. Such desk-top lighters are oftentimes designed in such a manner that they do not appear to be cigarette or cigar lighters at all but rather ornaments for adorning the desk of an office or the cocktail or coffee table of a living room. Such desk top lighters come in a large number of ornamental designs, some of which are scaled-down versions of everyday objects and some of which are scaled-down versions of unique objects. One such scaled-down object which has been successfully used in desk-top lighters has been the automobile, whether it be a replica of a vintage or a late model automobile. However, a problem associated with the incorporation of a cigarette or cigar lighter in such scaled-down versions of automobiles has been to camouflage or disguise the cigarette lighter elements so as not to detract from the aesthetic nature of the automobile design. For the most part, such attempts at camouflaging the cigarette lighter elements have not been successful or such an endeavor has not even been attempted so that such desk-top lighters invariably look like desk-top lighters even though they may otherwise be handsomely designed ornamentations.

Because of the nature of the cigarette lighter and its necessary elements of a fuel tank, valve or other means of expanding the fuel, an ignition system and a mechanism for activating the ignition system and igniting the fuel, it has not heretofore been attempted to provide pocket cigarette lighters, which must necessarily be relatively small, with ornamental and aesthetically pleasing designs. Although many such lighters are extremely expensive and constructed of precious metals, they are nevertheless primarily designed solely from the functional viewpoint of a cigarette lighter.

It is, therefore, a primary object of the present invention to provide a pocket cigarette or cigar lighter in the form of a miniature automobile wherein the cigarette lighter elements are wholly contained within the miniature automobile and form no extraneous elements or parts in addition to or apart from the automobile design itself.

Other objects and features of the present invention will become apparent from the following detailed description considered in connection with the accompanying drawings. It is to be understood, however, that the drawings are designed as an illutsration only and not as a definition of the limits of the invention.

In the drawings, wherein similar reference characters denote similar elements throughout the several views.

Figure 1:
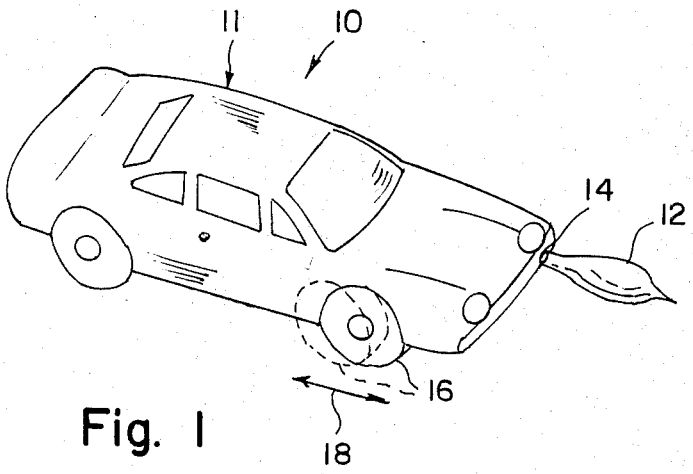
FIG. 1 is a perspective view of the pocket cigarette lighter according to the present invention.

Now turning to the drawings, there is shown in FIG. 1 a pocket cigarette lighter, generally designated 10, in the form of a miniaturized version of an automobile, designated 11, which is formed to such a scale as to be readily hand-held and fit within the user's pocket. As can be clearly appreciated from the appearance of the miniature automobile 11 of FIG. 1, the elements of the cigarette lighter mechanism are imperceptible to the viewer. In other words, the miniature automobile design of the pocket cigarette lighter 10 is unmarred by extraneous and unsightly elements attributable to the cigarette lighter itself. For instance, in FIG. 1 it can be seen that the flame, designated 12, produced by the pocket cigarette lighter 10 exits from an opening, designated 14, at the front of automobile 11 on the driver side or left side thereof. The flame 12 is activated by the user manipulating the passenger side or right side wheel, designated 16, of the automobile. As described hereinafter, the user merely moves wheel 16 rearwardly, as indicated by arrow 18, resulting in flame 12 emanating from opening 14. By releasing wheel 16, flame 12 is extinguished.

Figure 2:
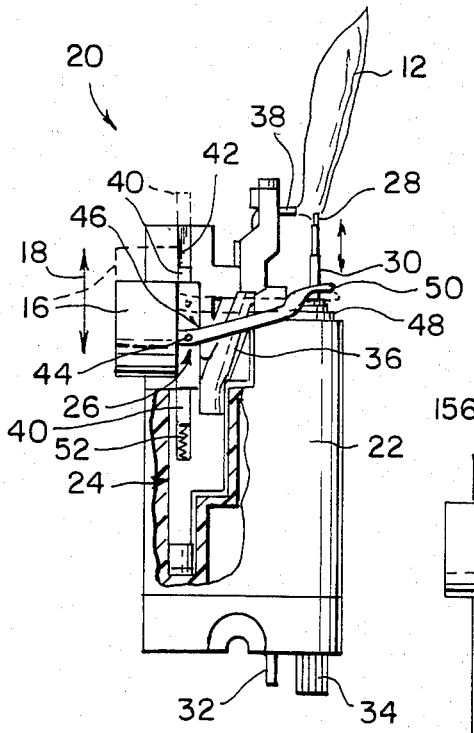
FIG. 2 is a side elevational view of the pocket cigarette lighter mechanism incorporated into the pocket cigarette lighter of FIG. 1, with a portion broken away.

In FIG. 2, there is shown the cigarette lighter mechanism, generally designated 20, which is housed within the body of miniature automobile 11 of pocket cigarette lighter 10. The cigarette lighter mechanism 20 is comprised of a fuel tank, designated 22, an ignition system, designated 24, and an ignition activation mechanism, designated 26. Fuel tank 22 contains the fuel which is released as a gas and ignited to form flame 12. The gas exits from fuel tank 22 through a nozzle 28 which is positioned at opening 14 of pocket cigarette lighter 10 in FIG. 1. A sliding gas valve, designated 30, is associated with nozzle 28 for releasing and throttling the gas through nozzle 28. For refueling fuel tank 22, there is also provided an inlet valve or nozzle, designated 32, to which the valve of the usual gas refueling tank can be administered. For adjustment of the volume of the gas exiting nozzle 28, there is also provided an adjustment knob 34 which may be positioned adjacent inlet nozzle 32. Adjustment knob 34 and filler nozzle 32, as with nozzle 28, are accessible through an opening or openings (not shown) preferably at the rear of the body of automobile 11 of pocket cigarette lighter 10.

Ignition system 24 which, in the case of the lighter mechanism 20 shown in FIG. 2, is a quartz ignition, generates a spark upon activation by ignition activation mechanism 26 which is transmitted through a spark conduit, designated 36, to a spark element 38 positioned adjacent nozzle 28. The spark at spark element 38 ignites the gas emanating from the nozzle. The quartz ignition system 24 is a commonly used ignition system for cigarette lighters and contains the same elements common to such ignition systems.

Ignition mechanism 26 performs the functions of operating gas valve 30 and activating ignition system 24 to produce the spark for igniting the gas emanating from nozzle 28. For activating ignition system 24, there is provided a vertically movable rod, designated 40, which is movable within a guide 42. Rod 40 is positioned above ignition system 24 and is vertically movable into the ignition system to act as a striker in producing the spark generated by the quartz crystal which is transmitted through the spark conduit 36 to spark element 38. Pivotally connected to rod 40 by means of pivot pin 44 is a lever, designated 46, which extends from rod 40 to sliding gas valve 30. Lever 46 is also pivoted about a fulcrum, designated 48, so that bifurcated lever arm 50 engages with gas valve 30 so that when rod 40 is moved vertically downwardly to generate a spark in ignition system 24, lever arm 50 raises sliding gas valve 30 thereby permitting gas to escape from nozzle 28. Rod 40 is biased by means of spring 52 to the inactive position shown in phantom in FIG. 2. In such a position, gas valve 30 is closed and ignition system 24 inactivated. For moving vertically movable rod 40, movable wheel 16 is fixed thereto and is movable by the user as indicated by arrow 18 from the position shown by dotted lines in FIG. 2 to the activated position shown by the solid lines in FIG. 2. Maintaining ignition activation mechanism 26 in the activation position or mode maintains sliding gas valve 30 in the release position so that gas continues to escape from nozzle 28 and flame 12 remains lighted.

Figure 3:
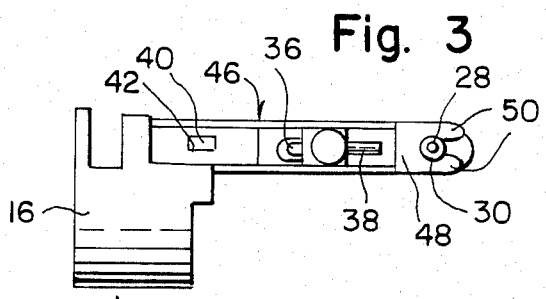
FIG. 3 is a top plan view of the cigarette lighter mechanism of FIG. 2.
Figure 4:
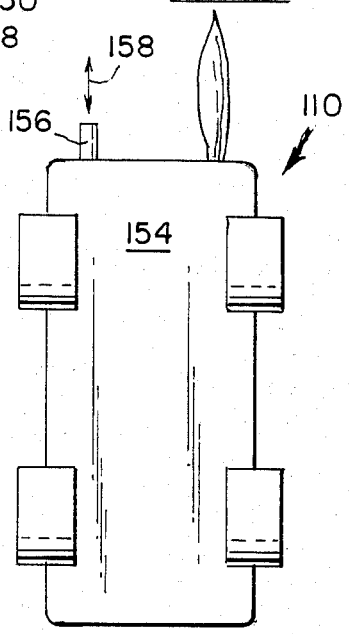
FIG. 4 is a bottom plan view of a second embodiment of the pocket cigarette lighter according to the present invention.
Figure 5:
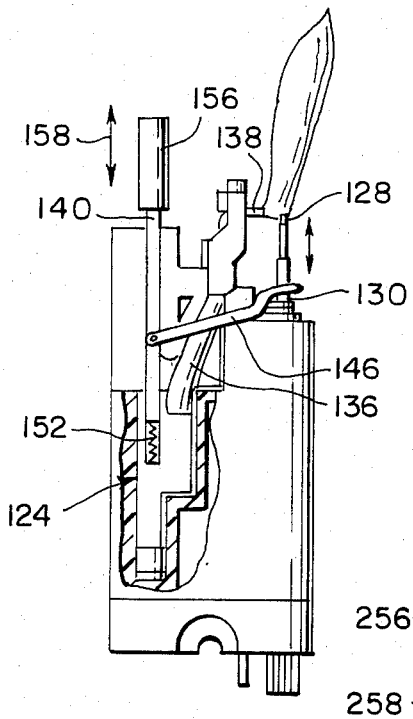
FIG. 5 is a side elevational view of the cigarette lighter mechanism of the pocket cigarette lighter embodiment of FIG. 4, with a portion broken away.

In FIGS. 4 and 5, there is shown an alternative means by which the gas valve and ignition system can be operated. In FIG. 4, the underside, designated 154, of the car body of pocket cigarette lighter 110 is shown wherein the exhaust pipe, designated 156, is adapted to operate valve 130 and ignition system 124. As clearly seen in FIG. 5, exhaust pipe 156 is fixedly attached to vertically movable rod 140 which has pivotally mounted thereto lever 146 for operating gas valve 130. As in the case of pocket cigarette lighter 10 of FIGS. 1, 2 and 3, vertically movable rod 140 activates ignition system 124 and is biased by means of spring 152 to the inactive position. Thus, when the user desires to produce a flame at nozzle 128, he merely depresses exhaust pipe 156, as indicated by the arrow, designated 158, which generates a spark in ignition system 124 which is transmitted through spark conduit 136 to spark element 138 to ignite the gas exiting from nozzle 128. The release of gas from nozzle 128 is accomplished by the action of lever 146 on gas valve 130 in a manner similar to that described in connection with the embodiment of FIGS. 1 to 3.

Figure 6:
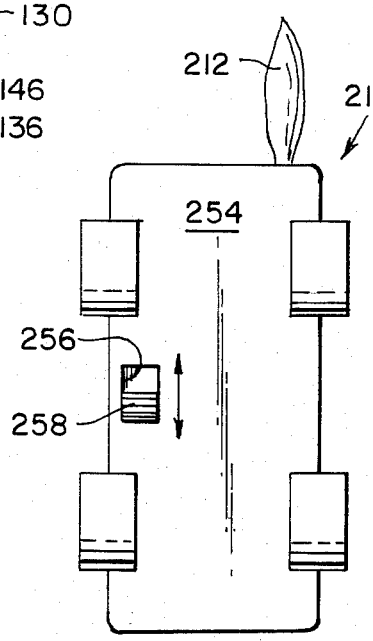
FIG. 6 is a bottom plan view of yet another embodiment of the pocket cigarette lighter according to the present invention.
Figure 7:
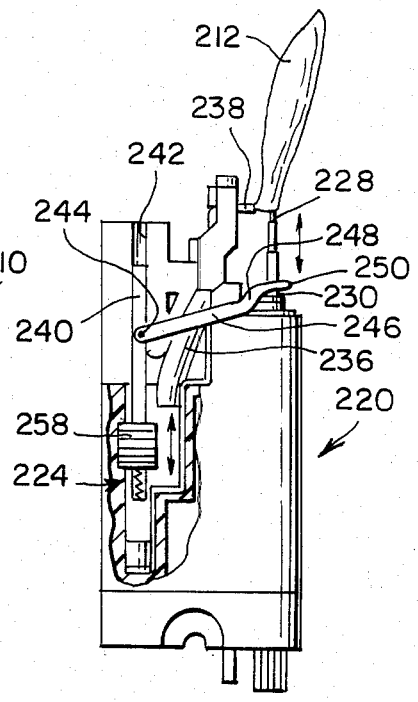
FIG. 7 is a side elevational view of the cigarette lighter mechanism of the pocket cigarette lighter embodiment of FIG. 6, with a portion broken away.

In FIGS. 6 and 7, yet another alternative means for operating the gas valve and ignition system is shown. Thus, in FIG. 6, the underside, designated 254, of the automobile body of pocket cigarette lighter 210 is shown having a opening, designated 256, for accommodating switch 258 for operating gas valve 230 and ignition system 224. As clearly seen in FIG. 7, switch 258 is operatively connected with rod 240 which is movable in guide 242 of the cigarette lighter mechanism 220, the downward stroke of which activates ignition system 224 to produce a spark which is transmitted through spark conduit 236 to spark element 238. Operating lever 246 is pivotally connected by pivot pin 244 to rod 240 so that when switch 258 is moved downwardly in FIG. 7, operating lever 246 is pivoted about fulcrum 248 so that bifurcated lever arm 250 raises sliding gas valve 230 to permit gas to escape from nozzle 228. The spark from spark element 238 ignites the gas escaping from nozzle 228 to produce flame 212.

Figure 8:
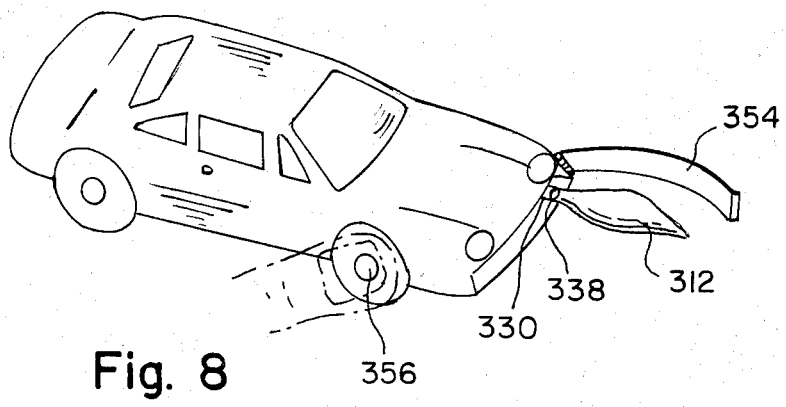
FIG. 8 is a perspective view of another embodiment of the pocket cigarette lighter according to the present invention.

In FIG. 8, there is shown yet another embodiment for operating the pocket cigarette lighter according to the present invention. The method demonstrated by FIG. 8 utilizes a light sensor switch in a wheel of the miniature automobile which is activated by merely touching the switch with a finger to produce ignition of the gas escaping from nozzle 338 of the cigarette lighter mechanism. As clearly seen in FIG. 8, it is necessary in order to operate the cigarette lighter mechanism for the nozzle 338 to be uncovered and for the gas valve 330 to be activated. For this purpose, a portion of the automobile body is movable such as the front end 354 of the automobile. Once front end 354 has been pivoted with respect to the automobile body, nozzle 338 is activated by gas valve 330 allowing gas to exit from nozzle 338 so that upon touching the light sensor switch 356, ignition is accomplished and flame 312 produced. In this embodiment it is necessary that the ignition system utilized comprise an electronic ignition system (described below) since activation is accomplished without the movement of mechanical parts.

Figure 9:
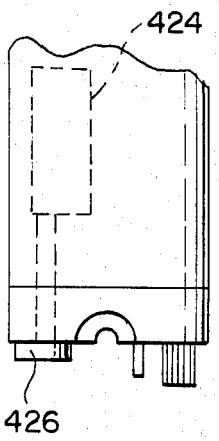
FIG. 9 is a side elevational view of a portion of an alternative cigarette lighter mechanism for use in the pocket cigarette lighter according to the present invention.

In FIG. 9, there is shown an electronic ignition system, designated 424, operated by means of a battery 426. The ignition activation mechanisms usable with this electronic ignition system can be the same as the mechanisms described above in connection with FIGS. 1 to 7. Obviously, other ignition systems may likewise be adapted for use in the pocket cigarette lighter according to the present invention.

While only a few embodiments of the present invention have been shown and described, it will be obvious that many changes and modifications may be made thereunto without departing from the spirit and scope of the present invention.

What is claimed is:

1. A gas fueled pocket cigarette lighter in the form of a miniature automobile, comprising:

(a) a hollow miniature automobile body having an opening therein for the cigarette lighter flame to issue therefrom;

(b) a cigarette lighter mechanism housed entirely within said hollow miniature automobile body including a fuel tank, a gas nozzle connected to said fuel tank and positioned at the flame opening of the miniature automobile body, a gas valve for admitting gas to said nozzle from said fuel tank and for throttling the same and an ignition system for generating a spark at the nozzle to ignite the fuel exiting therefrom; and (c) means forming part of said miniature automobile body for activating said ignition system for generating a spark and for operating said gas valve to permit fuel to exit from said nozzle.

2. The gas fueled cigarette lighter as defined in claim 1, wherein said gas valve is a slide valve operatively connected to said gas nozzle for releasing said gas through said nozzle in a first position thereof and throttling said gas therethrough in a second position.

3. The gas fueled cigarette lighter as defined in claim 2, which further includes an activation mechanism for moving said gas valve between said first and second positions and simultaneously with movement to said first position activating said ignition system to produce a spark at said nozzle igniting the fuel thereat, said activation mechanism being operated by means forming part of the automobile body.

4. The gas fueled cigarette lighter as defined in claim 3, wherein said activation mechanism includes biasing means biasing said activation mechanism to the second position of said gas valve.

5. The gas fueled cigarette lighter as defined in claim 4, wherein said activation mechanism includes a guided rod operatively connected to said ignition system and a lever pivotally mounted to said rod at a first end of said lever and having a fulcrum so that movement of said rod moves said gas valve between said first and second positions.

6. The gas fueled cigarette lighter as defined in claim 5, wherein said ignition system is a cigarette lighter quartz ignition system, said rod of said activation mechanism generates a spark in said quartz when moved to said first position, and conduit means for transmitting said spark to said gas nozzle.

7. The gas fueled cigarette lighter as defined in claim 5, wherein said ignition system is a cigarette lighter battery operated electronic ignition system, said rod of said activation mechanism generates a spark in said electronic ignition when moved to said first position, and conduit means for transmitting said spark to said gas nozzle.

8. The gas fueled cigarette lighter as defined in claim 4, wherein the means operating said activation mechanism comprises a wheel of the automobile body operatively connected thereto.

9. The gas fueled cigarette lighter as defined in claim 4, wherein the means operating said activation mechanism comprises a slide switch on the bottom of said automobile body.

10. The gas fueled cigarette lighter as defined in claim 4, wherein the means operating said activation mechanism comprises an exhaust pipe of the automobile body operatively connected thereto.

11. The gas fueled cigarette lighter as defined in claim 1, wherein said ignition system is a cigarette lighter battery operated electronic ignition, and the means for activating said ignition system comprises a light sensor switch operatively connected thereto.

12. The gas fueled cigarette lighter as defined in claim 11, wherein said light sensor switch is located in a wheel of said automobile body.

* * * * *